US009187983B2

(12) United States Patent
Guerrero et al.

(10) Patent No.: US 9,187,983 B2
(45) Date of Patent: Nov. 17, 2015

(54) DOWNHOLE ELECTRICAL ENERGY CONVERSION AND GENERATION

(75) Inventors: Julio C. Guerrero, Cambridge, MA (US); Jeffrey Lang, Sudbury, MA (US)

(73) Assignees: Schlumberger Technology Corporation, Sugar Land, TX (US); Massachusetts Institute Of Technology, Cambridge, MA (US)

( * ) Notice: Subject to any disclaimer, the term of this patent is extended or adjusted under 35 U.S.C. 154(b) by 499 days.

(21) Appl. No.: 13/290,529

(22) Filed: Nov. 7, 2011

(65) Prior Publication Data

US 2013/0112401 A1 May 9, 2013

(51) Int. Cl.
*E21B 41/00* (2006.01)

(52) U.S. Cl.
CPC ..... *E21B 41/0085* (2013.01)

(58) Field of Classification Search
CPC ..... E21B 41/0085
USPC ..... 166/65.1, 305.1
See application file for complete search history.

(56) References Cited

U.S. PATENT DOCUMENTS

| | | | | |
|---|---|---|---|---|
| 3,371,234 | A | 2/1968 | Cady | |
| 3,938,020 | A | 2/1976 | Bourke | |
| 4,388,594 | A | 6/1983 | Deskins et al. | |
| 4,618,470 | A | 10/1986 | Salisbury | |
| 5,031,700 | A * | 7/1991 | McDougall et al. | 166/307 |
| 5,606,213 | A | 2/1997 | Kherani et al. | |
| 6,097,188 | A | 8/2000 | Sweedler et al. | |
| 6,253,847 | B1 * | 7/2001 | Stephenson | 166/248 |
| 6,433,465 | B1 | 8/2002 | McKnight et al. | |
| 6,532,740 | B1 | 3/2003 | Sullivan | |
| 6,745,833 | B2 * | 6/2004 | Aronstam et al. | 166/250.11 |
| 6,856,036 | B2 | 2/2005 | Belinsky | |
| 7,077,200 | B1 * | 7/2006 | Adnan et al. | 166/250.01 |
| 7,116,036 | B2 | 10/2006 | Balasubramaniam et al. | |
| 7,521,841 | B2 | 4/2009 | Clingman et al. | |
| 2003/0019621 | A1 * | 1/2003 | Schultz et al. | 166/65.1 |
| 2005/0134149 | A1 | 6/2005 | Deng et al. | |
| 2006/0022555 | A1 | 2/2006 | Balasubramaniam et al. | |
| 2006/0063522 | A1 | 3/2006 | McFarland | |
| 2006/0130476 | A1 | 6/2006 | Fitch et al. | |
| 2006/0133733 | A1 | 6/2006 | Koste et al. | |
| 2006/0175937 | A1 | 8/2006 | Clingman et al. | |
| 2007/0018110 | A1 | 1/2007 | McGregor et al. | |
| 2011/0257491 | A1 * | 10/2011 | Robertson et al. | 600/302 |
| 2012/0132418 | A1 * | 5/2012 | McClung, III | 166/250.12 |
| 2012/0178653 | A1 * | 7/2012 | McClung, III | 507/269 |
| 2013/0032357 | A1 * | 2/2013 | Mazyar et al. | 166/376 |

FOREIGN PATENT DOCUMENTS

| | | |
|---|---|---|
| EP | 1654771 | 5/2006 |
| GB | 1116451 A | 6/1968 |
| WO | 2006093790 A2 | 9/2006 |

OTHER PUBLICATIONS

The American Heritage® Science Dictionary—2005 version.*

* cited by examiner

*Primary Examiner* — Jennifer H Gay
*Assistant Examiner* — Steven MacDonald
(74) *Attorney, Agent, or Firm* — Bridget M. Laffey; Jakub Michna; Daniel S. Matthews

(57) ABSTRACT

A procedure and device for electric energy generation from electrochemical use of substances for powering downhole devices and a procedure and device for electric energy generation from nuclear decay for powering downhole devices. The types of devices being powered are untethered or otherwise cannot benefit from direct power transmission from the surface.

11 Claims, 5 Drawing Sheets

DOWNHOLE ELECTRICAL ENERGY CONVERSION AND GENERATION

FIELD

The subject disclosure relates to the field of downhole electrical energy generation. More specifically, the subject disclosure relates to techniques for electrical energy generation from electro chemical reactions and/or nuclear decay for powering devices in downhole environments.

BACKGROUND

There are many different approaches to the generation of electrical energy which include: 1) using piezoelectric devices to convert vibration into electric energy, 2) converting energy from ocean waves into electric energy, 3) converting coriolis effect into energy, 4) using the electrical response phenomenon of electrostrictive polymers to harvest electrical power from the general movement of objects e.g. human walking motion, 5) converting EM radiation into electrical energy, 6) energy scavengers which adjust their frequency by altering liquid distributions on a beam, 7) collecting acoustic energy and transforming the acoustic energy into electrical energy for use by a sensor, 8) transmitting energy by pressure oscillations in a fluid, and 10) different systems for storing the energy and using the stored energy to power sensors.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with some embodiments an apparatus and a method for converting electrochemical energy to electrical energy downhole is described. The apparatus includes a first electrode and a second electrode, the first and second electrodes being adapted and arranged to be deployed downhole and to form an anode and a cathode respectively upon exposure to an acidic fluid in a downhole environment, thereby generating electrical energy; and a downhole device adapted and arranged to be energized by the generated electrical energy while in a downhole environment. According to some embodiments the downhole device such as a sensor and/or a burrowing device, is less than about 1 mm in size and can be deployed via pumping into the formation.

According to some embodiments an apparatus for converting nuclear energy to electrical energy downhole is described. A first conductor contains a decaying radioactive isotope (such as $^{63}$Ni and/or $^{45}$Ca) which emits primarily electrons; a second conductor adapted and arranged to accept the electrons emitted by the first conductor and the first and second conductors adapted and arranged so as to form a capacitor that is charged by the emitted and accepted electrons, and to be deployed in a downhole environment; and a downhole device adapted to be energized using electrical energy stored in the capacitor. According to some embodiments, the apparatus is untethered with the surface such that electrical power from the surface is unavailable to the device Further features and advantages will become more readily apparent from the following detailed description when taken in conjunction with the accompanying drawings.

DETAILED DESCRIPTION

Figure 1:
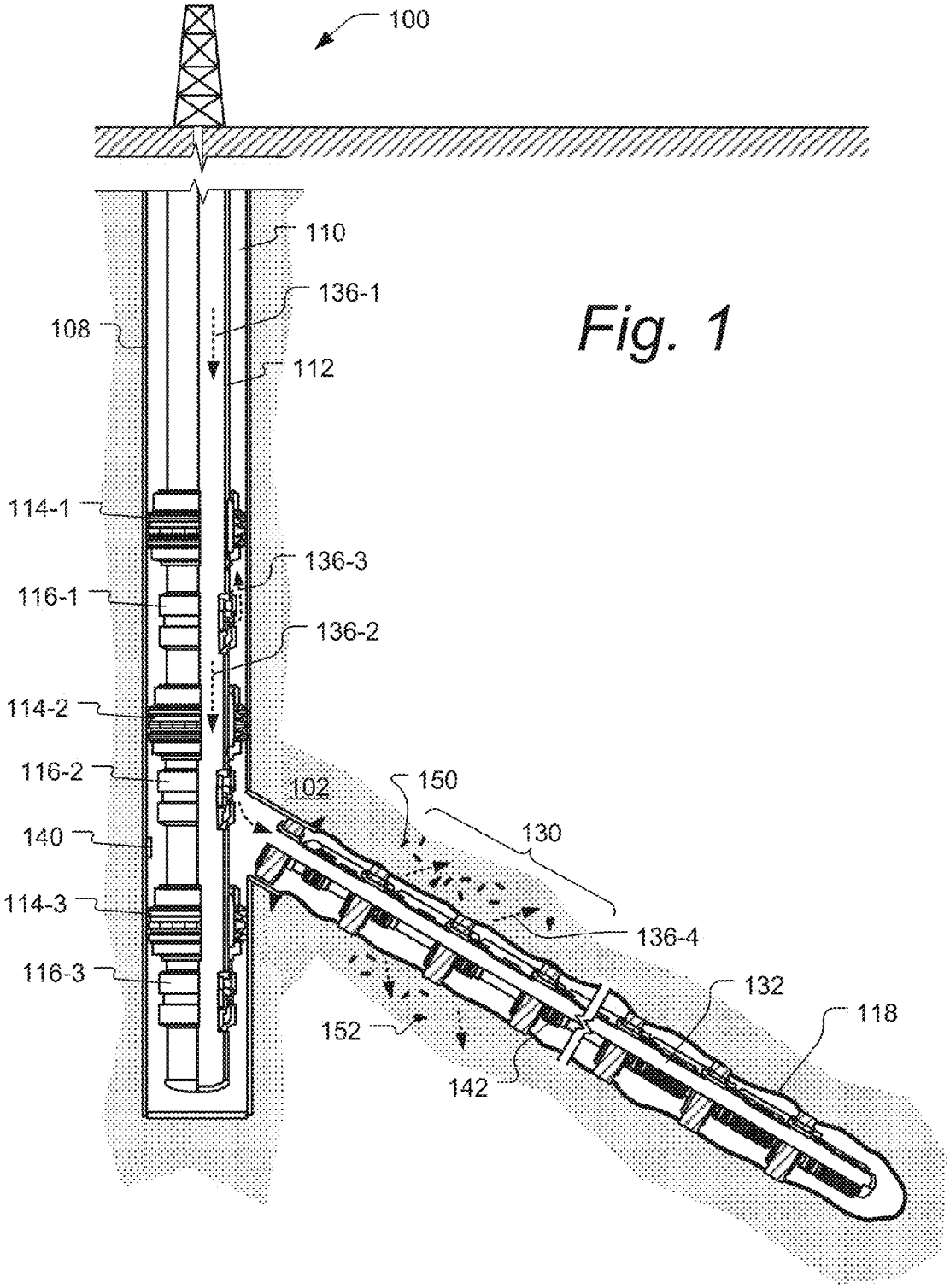
FIG. 1 illustrates an oilfield wellbore setting in which the electrical energy generation techniques can be used, according to some embodiments.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicate like elements.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in each embodiment. A process may correspond to a method, a function, a procedure, a subroutine, a subprogram, etc. When a process corresponds to a function, its termination corresponds to a return of the function to the calling function or the main function.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the required tasks may be stored in a machine readable medium. A processor(s) may perform the required tasks.

According to some embodiments, procedures and devices are described for electric energy generation from electrochemical use of substances for powering downhole devices. According to some other embodiments procedures and devices are described for electric energy generation from nuclear decay for powering downhole devices. According to some embodiments, the types of devices being powered are untethered or otherwise cannot benefit from direct power transmission from the surface. Examples of devices include small devices in downhole environments. Other examples of devices are sensors and other hardware such as flow control valves installed during completion. According to one example permanent and/or semi-permanent monitoring sensors make use of the energy generation techniques described herein.

According to some embodiments, methods and devices are described for electric energy generation from nuclear decay for powering devices, for example, small devices in downhole environments. The devices extract electrical energy from nuclear decay that produces charged particles. In such devices, the procedure uses a decaying isotope that emits kinetically-energetic charged particles which is placed on one side of a capacitor. The kinetic energy of the particles carries them to the opposing side of the capacitor where they are collected, thereby charging the capacitor. The process continues until the potential energy across the charged capacitor gap matches the kinetic energy of the emitted particles. As the capacitor is discharged, its voltage decreases, and charging resumes until the isotope has fully decayed.

According to some other embodiments, methods and devices are described for electric energy generation from electrochemical use of acid for powering devices, for example, small devices in downhole environments. The devices have two different metal electrodes and when the devices are immersed in an acidic electrolyte, the devices generate electric energy. According to some embodiments, the devices do not carry the acidic electrolyte. Rather, acid is injected into the well for several operations, as is common in the oilfield industry.

FIG. 1 illustrates an oilfield wellbore setting in which the electrical energy generation techniques can be used, according to some embodiments. Wellbore 110 is shown having a wellsite 100 on the surface. Below the ground, wellbore 110 is shown completed with a casing 108 and production tubing 112 through which produced fluids, such as hydrocarbon fluids, are brought to the surface. The vertical section of the wellbore 110 has a number of packers 114-1, 114-2 and 114-3 that are used to isolate regions of the wellbore from each other and valves 116-1, 116-2 and 116-3 are shown, for example, to control flow into (and out of) the production tubing 112. For example, valve 116-2 can be used to control flow of produced fluids from the lateral 118 into the production tubing 112. Although not shown, other regions which may be isolated by packers and controlled by valves may be present such as other laterals and/or perforated regions of the casing 108. Lateral 118 is shown completed with tubing 132 in an uncased fashion. The hardware shown in FIG. 1 are simply examples and the embodiments described herein are operable with many other types of completions such as perforated casing, sands screens, gravel pack, etc. Also shown is a permanently installed sensor 140, and several flow control valves in the lateral completion such as valve 142. Small devices such as miniature burrowing devices 150 and miniature sensing system 152 are shown deployed in the region 130 of formation 102.

According to some embodiments, various devices such as one or more of sensor 140, valves 116-1, 116-2, 116-3, 142, and small devices 150 and 152 make use of energy generating using electrochemical reactions and/or nuclear decay, as will be described in further detail herein. In the case of electrochemical reaction energy generation, according to some embodiments, an acid is pumped into the wellbore 136 and into formation 102. Arrows 136-1, 136-2, 136-3 and 136-4 show the path of acid influx. According to some embodiments the acid is introduced as part of a treatment or other servicing of the wellbore, but is also beneficially used in the generation of electrical energy.

Figure 2:
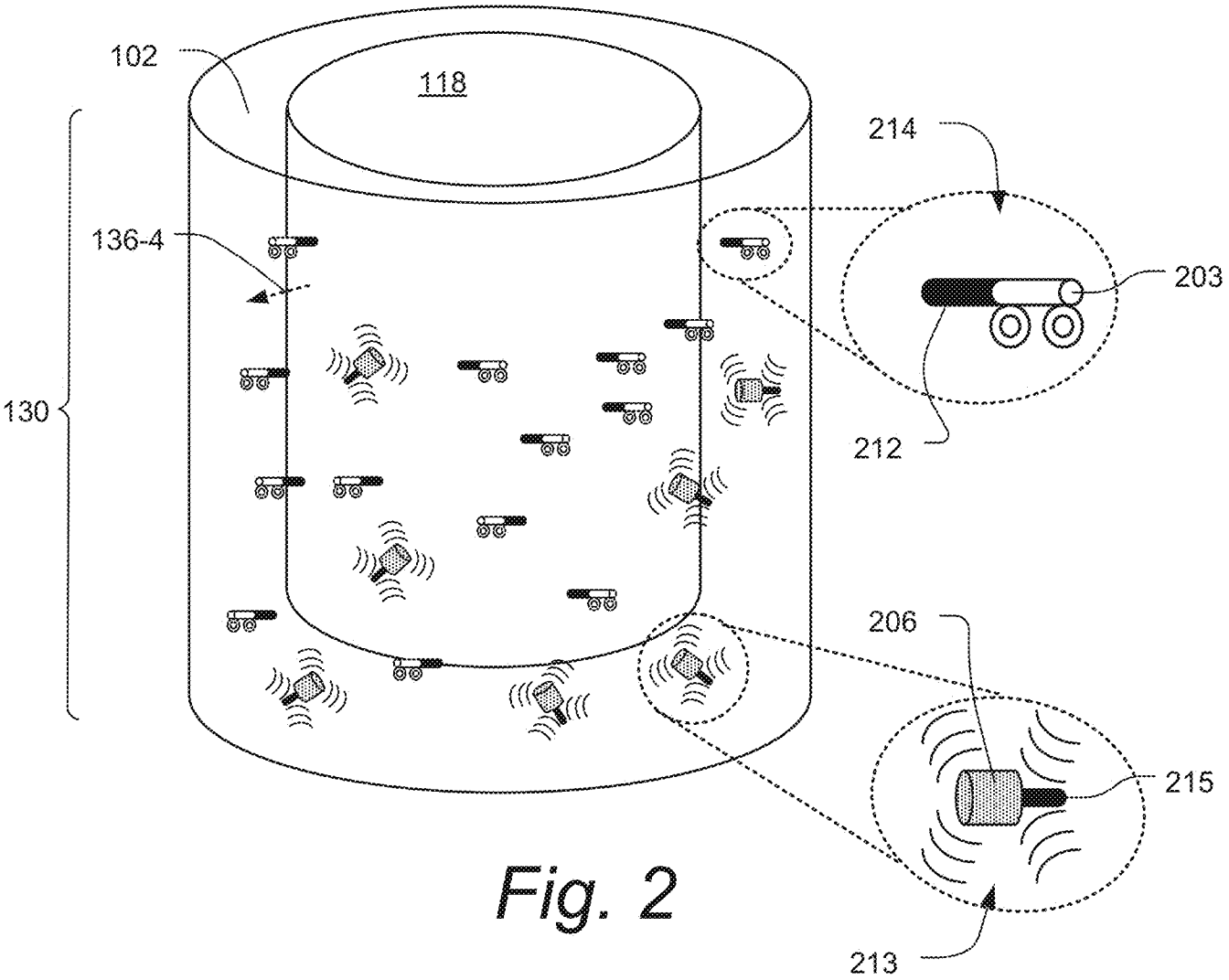
FIG. 2 shows further details of deployment of a number of small devices making use of downhole electrical energy generation, according to some embodiments.

FIG. 2 shows further detail of deployment of a number of small devices making use of downhole electrical energy generation, according to some embodiments. Shown is a section of lateral wellbore 118 and a portion 130 of the formation 102 that surrounds the wellbore 118. A number of small devices are shown which have been deployed, for example by pumping into the formation 102. According to some embodiments, the small devices are less than about 1 mm in size, but in general the devices should be on the order of the grain size associated with the formation 102 or smaller. A number of burrowing and/or crawling systems are shown, one of which is burrowing/crawling system 214. Each burrowing/crawling system has a burrowing device, such as burrowing device 203 and an electrical energy generator, such as generator 212. A number of sensing systems are shown such as sensing system 213 is shown. Each sensing system has a sensor, such as sensor 206 and an electrical energy generator, such as generator 215. According to some embodiments the electrical energy generators use nuclear decay, such as will be described in further detail with respect to FIG. 3, and according to other embodiments the electrical energy generators use electrochemical reactions, such as will be described in further detail in FIGS. 4 and 5. According to some embodiments a combination nuclear decay and electrochemical techniques are used. In the case of electrochemical reaction electrical energy generation, an acid is introduced into the formation 102 from the wellbore 118 as shown by arrow 136-4.

Figure 3:
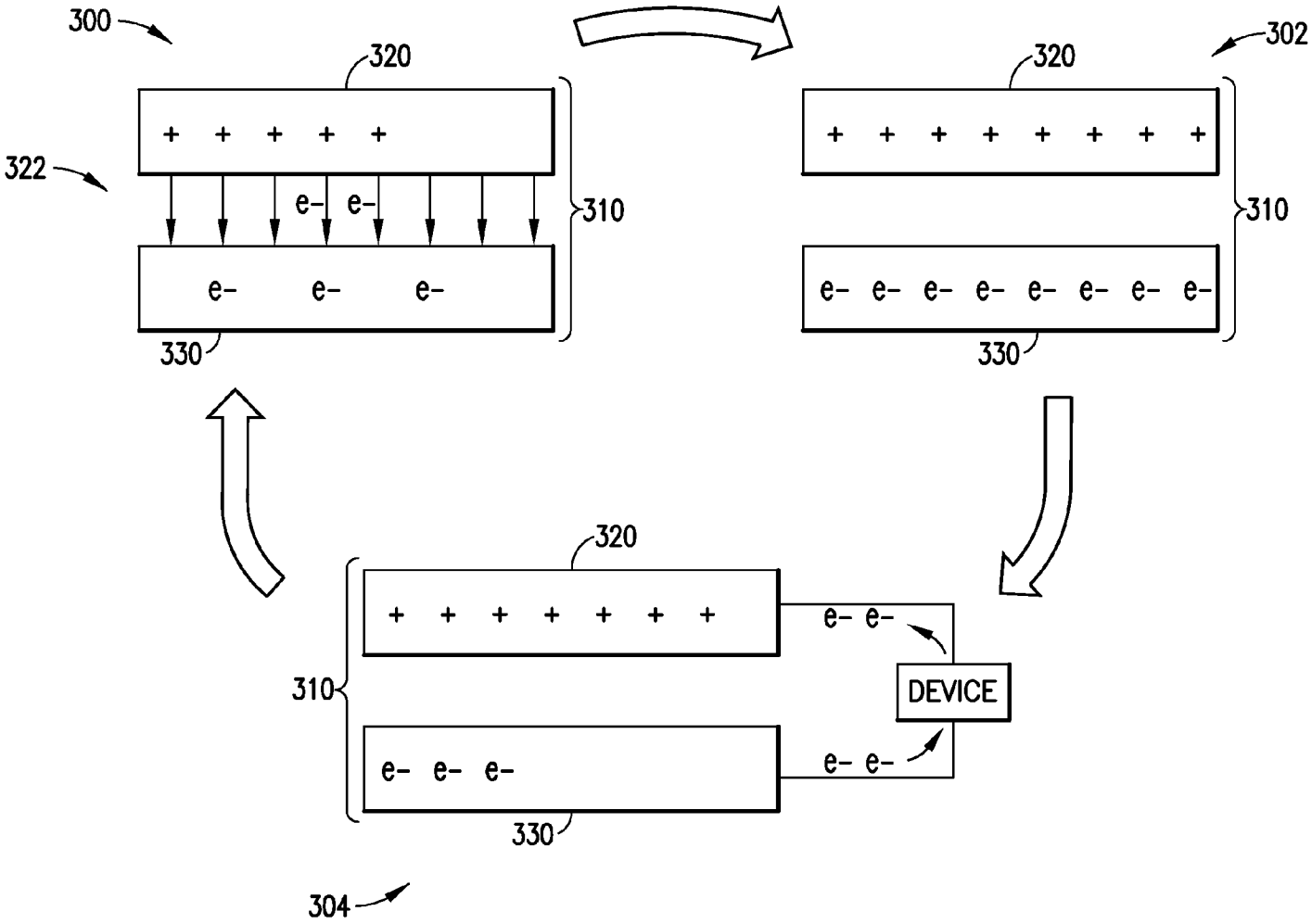
FIG. 3 shows further details of downhole electrical energy generation using nuclear decay, according to some embodiments.

FIG. 3 shows further details of downhole electrical energy generation using nuclear decay, according to some embodiments. The techniques shown in FIG. 3, for example can be used in the generators 212 and 215 shown in FIG. 2, as well as in devices such as sensor 140, valves 116-1, 116-2, 116-3, 142, and small devices 150 and 152 shown in FIG. 1. The generation device is a long-life high-density source of electrical energy that is extracted from nuclear decay that produces charged particles. In such a device, the procedure comprises using a decaying isotope that emits kinetically-energetic charged particles placed on one side of a capacitor. The kinetic energy of the particles carries them to the opposing side of the capacitor where they are collected, thereby charging the capacitor. The process continues until the potential energy across the charged capacitor gap matches the kinetic energy of the emitted particles. As the capacitor is discharged, its voltage decreases, and charging resumes until the isotope has fully decayed.

Referring to FIG. 3, in phase 1 (300), the generation device includes a capacitor 310 having a first conductor 320 which includes a decaying isotope and emits kinetically-energetic charged particles 322 which are collected by the opposite conductor 330. In phase 2 (302), the conductor 330 has collected sufficient charged particles so as to be charged and the potential energy across the charged capacitor gap matches the kinetic energy of the emitted particles. In phase 3 (304) the capacitor 310 is discharged and the capacitor voltage decreases while it energizes the device (e.g. sensor, burrowing device, valve, etc.). As the charge has decreased, the charging resumes as shown in phase 1 (300). The cycle continues until the isotope has fully decayed.

According to some embodiments, it has been found that the isotope $^{63}$Ni possess safety properties including: (1) the isotope is a beta emitter (that is, it emits electrons); (2) the isotope decays to a stable atom; and (3) the emitted beta particles have relatively low energy that minimize the secondary emission of x-rays during collection. According to some embodiments, the isotope $^{45}$Ca is used which is a weak alpha emitter. According to some embodiments, a combination of isotopes is used. The half-life of $^{63}$Ni in embodiments is 101 years. The specific power of $^{63}Ni$ is near 2.4 mW/g, with an optimal collection voltage of 17 kV. The isotope $^{45}Ca$ has a shorter half-life of 163 days, and a specific power near 2.9 W/g, with an optimal collection voltage of 65 kV. The optimal collection voltage of these embodiments is very high compared to the voltage of typical circuitry being powered. Accordingly, the use of one or more of these embodiments is an energy source enabler of many devices. Example devices include: autonomous electrical and electromechanical devices for oil-drilling, logging, sand control, sensing, actuation, etc. The described embodiments thus provide a simple, long-life, low-cost, power source of electrical energy that is suitable for powering small autonomous devices such as shown in FIG. 2. According to some embodiments, lesser amounts of power are produced at lesser voltages. When designing the generator, optimal collection voltage may be used.

Thus, according to some embodiments a procedure and a device for electric energy generation from nuclear decay for powering devices is provided, for example, small devices in downhole environments. According to some embodiments, devices powered according to the described techniques are inserted into the formation that surrounds an oil well while they are connected to micro devices that are powered by the generation system. The devices can be burrowing systems, micro robots, sensors, actuators of mechanisms such as deployable structures or others, etc.

Further details regarding electrical energy generation from electrochemical reactions will now be provided. The generation device according to these embodiments has two different metal electrodes. When the device is immersed in a medium that is impregnated in acidic electrolyte, the device generates electrical energy. According to some embodiments, the device does not carry the acidic electrolyte with it. In such a device, the procedure relies on having electrons moving from one of its metal electrodes to the other. The acid works as a bridge that facilitates the chemical reaction between anode, one of the metals, and the cathode, the other metal.

In oil exploration, acid is injected into the well for several operations. According to some embodiments, the device is immersed in the downhole formation fluid impregnated with acid. The device uses the acid as one of the components to provoke the electrochemical energy transformation. The energy transformation will occur when the electric circuit is closed. Advantageously, the electrodes are consumed when the circuit is closed. Some embodiments of this invention consist of the two electrodes separated by a volume that contains sensors, transmitters, electromechanical devices, etc.

According to some embodiments, the energy transformation process continues until the electrodes are consumed or the acid is not available in the environment in which the device is submerged or inserted.

Environments in which acid is present make this a particularly attractive energy source enabler of many devices. For example, the electrochemical generation techniques described herein can be used with autonomous electrical and electromechanical devices for oil-drilling, logging, sand control, sensing, actuation, and burrowing robotic devices, etc.

According to some embodiments, the generator can be used as an energizing module of locomotion systems, i.e. burrowing devices such as shown in FIG. 2. According to some other embodiments, the generator can be used as the energizing module of sensing systems such as shown in FIG. 2.

Figure 4:
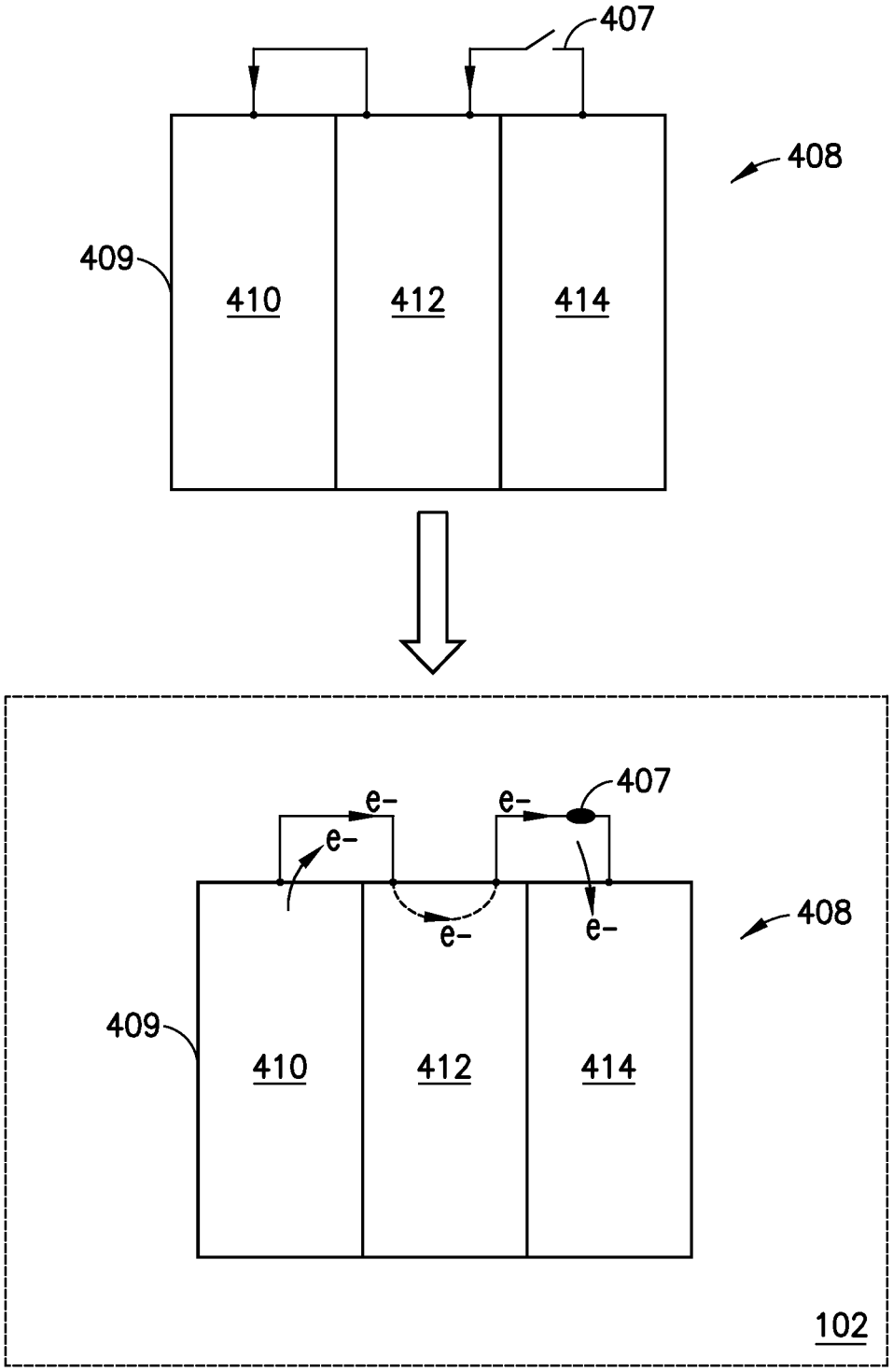
FIG. 4 illustrate a powered device sandwiched between two metallic electrodes, according to some embodiments.

FIG. 4 illustrate a powered device sandwiched between two metallic electrodes, according to some embodiments. Energy generation device 408 includes a frame 409 which is used to house electrodes 410 and 414 which form the anode and cathode respectively. The powered device 412 is sandwiched between the electrodes 410 and 414. The powered device 412 can be, for example, a device such as sensor 140, valves 116-1, 116-2, 116-3, 142, and/or small devices 150 and 152 shown in FIG. 1. As shown in the top figure of FIG. 4, the generation device 408 is not exposed to acid, and the switch 407 is open. As shown in the bottom figure of FIG. 4, the generation device 408 is exposed to an acidic fluid being held in the formation 102. The electrons travel from the anode to the cathode as shown.

Figure 5:
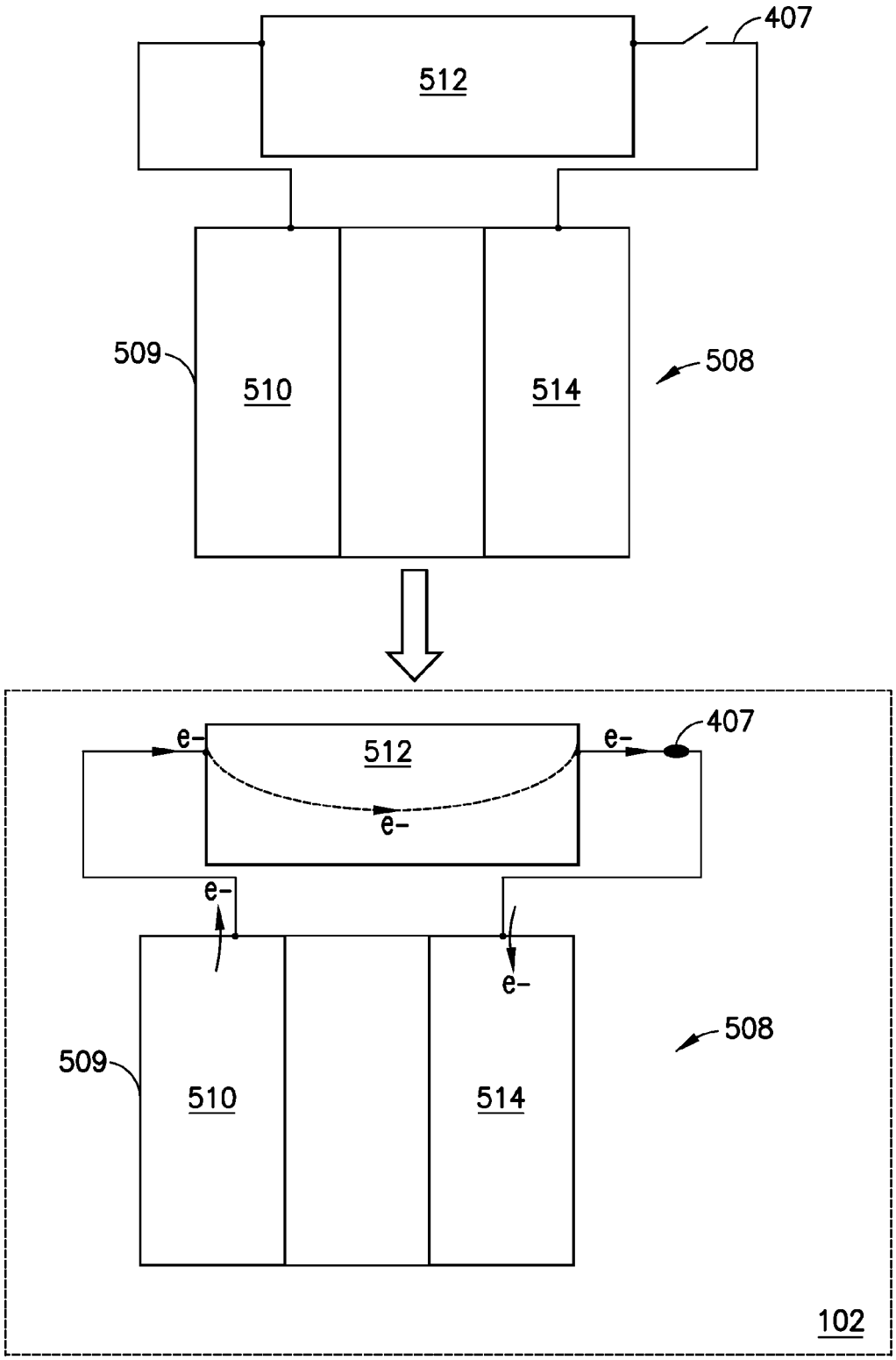
FIG. 5 illustrate a power device that is not sandwiched between two metallic electrodes, according to some other embodiments.

FIG. 5 illustrates a power device that is not sandwiched between two metallic electrodes, according to some other embodiments. Energy generation device 508 includes a frame 509 which is used to house electrodes 510 and 514 which form the anode and cathode respectively. Unlike the arrangement shown in FIG. 4, the powered device 512 is not sandwiched between the two electrodes 510 and 514. The powered device 512 can be, for example, a device such as sensor 140, valves 116-1, 116-, 116-3, 142, and/or small devices 150 and 152 shown in FIG. 1. As shown in the top figure of FIG. 5, the generation device 508 is not exposed to acid, and the switch 507 is open. As shown in the bottom figure of FIG. 5, the generation device 508 is exposed to an acidic fluid being held in the formation 102. The electrons travel from the anode to the cathode as shown.

According to some embodiments, one or more of the techniques discussed in the following references which relate to nuclear battery technology can be used in connection with the teachings herein: U.S. Pat. No. 6,097,188; U.S. Patent Application Publ. No. 2007/0018110; U.S. Pat. Nos. 4,618,470; and 5,606,213, each of which is incorporated by reference herein.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wood parts together, whereas a screw employs a helical surface, in the environment of fastening wood parts, a nail and screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. A system for converting electrochemical energy to electrical energy downhole comprising:

an acidic fluid delivered downhole as part of a downhole wellbore treatment;

a first electrode;

a second electrode, the first and second electrodes being adapted and arranged to be deployed downhole and to form an anode and a cathode respectively upon exposure to the acidic fluid in a downhole environment, thereby generating electrical energy;

a downhole device adapted and arranged to be energized by the generated electrical energy while in the downhole environment; and wherein the downhole device is arranged such that it is located between the first and second electrodes and is untethered with the surface such that electrical power from the surface is unavailable to the downhole device.

2. A system according to claim 1 wherein the downhole device is less than about 1 mm in size.

3. A system according to claim 2 wherein the downhole device is a sensor or a burrowing device.

4. A system according to claim 1 wherein the downhole device is adapted to be deployed within a subterranean hydrocarbon formation.

5. A system according to claim 1 wherein the downhole device is associated with a completion.

6. An apparatus according to claim 5 wherein the downhole device is a sensor or a flow control valve.

7. A method for converting electrochemical energy to electrical energy downhole comprising:

introducing an apparatus into a downhole environment, the apparatus comprising a first electrode, a second electrode and a downhole device;

exposing the first electrode and the second electrode to an acidic fluid in the downhole environment thereby causing the first and second electrodes to form an anode and a cathode respectively, thereby generating electrical energy;

energizing the downhole device using the generated electrical energy; and wherein the downhole device is arranged such that it is located between the first and second electrodes and the apparatus is untethered with the surface such that electrical power from the surface is unavailable to the downhole device.

8. A method according to claim 7 wherein the downhole environment is the environment of a hydrocarbon wellbore.

9. A method according to claim 7 further comprising pumping the acidic fluid through a borehole as part of a treatment service for the borehole.

10. A method according to claim 7 wherein the downhole device is less than about 1 mm in size.

11. A method according to claim 10 wherein the device is a sensor or a burrowing device that is adapted to be deployed within a subterranean rock formation.

* * * * *